US010155295B2

(12) United States Patent
Huang et al.

(10) Patent No.: US 10,155,295 B2
(45) Date of Patent: Dec. 18, 2018

(54) ABRASIVE BELT GRINDING DEVICE FOR PROFILE PRECISION CONSISTENCY

(71) Applicants: CHONGQING UNIVERSITY, Chongqing (CN); CHONGQING SAMHIDA GRINDING MACHINE COMPANY, Chongqing (CN)

(72) Inventors: Yun Huang, Chongqing (CN); Junfeng Yang, Chongqing (CN); Guijian Xiao, Chongqing (CN); Lai Zou, Chongqing (CN); Ying Liu, Chongqing (CN); Ping Li, Chongqing (CN)

(73) Assignees: CHONGQING UNIVERSITY, Chongqing (CN); CHONGQING SAMHIDA GRINDING MACHINE COMPANY, Chongqing (CN)

( * ) Notice: Subject to any disclaimer, the term of this patent is extended or adjusted under 35 U.S.C. 154(b) by 6 days.

(21) Appl. No.: 15/546,424

(22) PCT Filed: Dec. 13, 2016

(86) PCT No.: PCT/CN2016/109704
§ 371 (c)(1),
(2) Date: Jul. 26, 2017

(87) PCT Pub. No.: WO2018/000747
PCT Pub. Date: Jan. 4, 2018

(65) Prior Publication Data

US 2018/0215007 A1 Aug. 2, 2018

(30) Foreign Application Priority Data

Jun. 29, 2016 (CN) ..... 2016 1 0485618

(51) Int. Cl.
*B24B 21/16* (2006.01)
*B24B 21/20* (2006.01)

(52) U.S. Cl.
CPC ..... *B24B 21/165* (2013.01); *B24B 21/16* (2013.01); *B24B 21/20* (2013.01)

(58) Field of Classification Search
CPC ..... B24B 21/165; B24B 21/16; B24B 21/20
(Continued)

(56) References Cited

U.S. PATENT DOCUMENTS 2,802,929 A * 8/1957 Fefer ..... B24B 21/16 219/69.2
4,031,668 A * 6/1977 Lasko ..... B24B 21/16 451/299

(Continued)

FOREIGN PATENT DOCUMENTS

CN 103786082 A 5/2014
CN 104084866 A 10/2014
CN 105945691 A 9/2016

OTHER PUBLICATIONS

International Search Report for PCT/CN2016/109704, dated Mar. 1, 2017, ISA/CN.

*Primary Examiner* — George Nguyen
(74) *Attorney, Agent, or Firm* — U.S. Fairsky LLP; Yue (Robert) Xu

(57) ABSTRACT

An abrasive belt grinding device is provided, a supporting plate passes through an inner cylinder, and is fixed to the inner cylinder, the inner cylinder is rotatably connected to an outer cylinder bracket, a winding reel and an unwinding reel are arranged side by side in a left-right direction at an upper end of the supporting plate, and are driven by respective first servo motors, one end of the abrasive belt is wound in a belt groove of the winding reel, and another end of the abrasive belt is wound over the first transition wheel, the first tension pulley, the third transition wheel, the fifth transition wheel, the seventh transition wheel, the contact wheel, the eighth transition wheel, the sixth transition wheel, the fourth tran- (Continued)

sition wheel, the second tension pulley, and the second transition wheel, and is finally wound in a belt groove of the unwinding reel.

12 Claims, 3 Drawing Sheets

(58) Field of Classification Search
USPC ..... 451/311
See application file for complete search history.

(56) References Cited

U.S. PATENT DOCUMENTS

| | | | | |
|---|---|---|---|---|
| 4,608,037 | A * | 8/1986 | Fleming, III | B24B 7/13 226/171 |
| 4,669,224 | A * | 6/1987 | Armstrong | B24B 21/16 451/296 |
| 5,830,046 | A * | 11/1998 | Dugger | B24B 21/14 451/297 |
| 8,216,026 | B2 * | 7/2012 | Joslin | B24B 21/165 451/302 |
| 2007/0259608 | A1 * | 11/2007 | Bechtold | B24B 13/01 451/310 |

* cited by examiner

ABRASIVE BELT GRINDING DEVICE FOR PROFILE PRECISION CONSISTENCY

This application is the national phase of International Application No. PCT/CN2016/109704, titled "ABRASIVE BELT GRINDING DEVICE FOR PROFILE PRECISION CONSISTENCY", filed on Dec. 13, 2016, which claims the benefit of priority to Chinese Patent Application No. 201610485618.0 titled "ABRASIVE BELT GRINDING DEVICE FOR PROFILE PRECISION CONSISTENCY", filed with the Chinese State Intellectual Property Office on June 29, 2016, the entire disclosures of which are incorporated herein by reference.

FIELD

The present application relates to the field of flexible abrasive belt grinding, and more particularly to an abrasive belt grinding device for profile precision consistency.

BACKGROUND

Thin-walled members such as blisks, aeroengine blades, turbine blades are key functional structural parts of airplanes, vessels and so on, and the level of machining of these parts directly determines the development of industries such as aerospace and navigation. In one aspect, these thin-walled members have complex curved surfaces, and are hard to be machined automatically; in another aspect, high requirements are imposed on the machining precision and surface quality of key parts such as blisks, and the surface quality issues such as surface burning and surface defects should be avoided, and in addition, the machining efficiency should also be guaranteed.

The thin-walled members such as blisks are mainly made of high-strength, heat-resistant and corrosion-resistant materials such as titanium alloy and nickel-based alloy, and pertain to typical complex structural parts having an integrally thin-walled structure and being hard to machine. Generally, these thin-walled members are first roughly machined to be shaped by five-shaft numerical control milling and linear friction welding or the like, and then are grinded and polished. Currently, manual grinding is mainly employed in engineering practice, and this way has a low efficiency, and has lots of issues such as a high rejection rate, a poor product consistency, and a low economy benefit, which seriously restricts the large area promotion and application of blisks in the aerospace field.

Abrasive belt grinding uses an abrasive belt as a grinding tool to machine the surface of a workpiece, and belongs to a flexible grinding, and can obtain a higher material removing rate and a better surface quality compared with grinding with a grinding wheel. In addition, the significant advantages of the abrasive belt grinding are as follows, it has higher grinding flexibility and adaptability, and can realize the grinding of planes, holes and grooves, and complex curved surfaces by changing the dimension of a contact wheel. The complex structural parts such as blisks cannot be machined by a grinding machine tool using the grinding wheel, and must be grinded by an abrasive belt grinding head with a small-diameter contact wheel. Zhi GENG et al. in Zhengzhou Research Institute for Abrasive & Grinding made experimental researches on the principle of abrasive belt grinding, and studied the effects of a contact wheel, an abrasive belt, and grinding parameters on material removal and surface generation, thus providing a theoretical support for the abrasive belt grinding.

In recent years, automatic abrasive belt grinding machine tools have been developed rapidly. Huazhen ZHONG et al. in Huazhong University of Science and Technology made research on numerical control abrasive belt grinding of steam turbine blades. Multi-shaft linkage numerical control machine tools and corresponding numerical control system have been well developed, for example, numerical control lathes, numerical control milling machines, and numerical control machining centers, however, the research on multi-shaft numerical control grinding machines relatively lags behind, the key point is that an abrasive belt grinding and polishing device is required to not only realize the adjustment of a grinding force, but also realize control of the linear speed, winding and unwinding of the abrasive belt. In engineering, grinding and polishing heads fully meeting these requirements have not been applied in China, which significantly restricts the promotion, application and development of the multi-shaft numerical control grinding machines.

SUMMARY

In view of the above deficiencies of the conventional technology, the technical issue to be addressed by the present application is to provide an abrasive belt grinding device for profile precision consistency.

The technical solution of the present application is as follows. An abrasive belt grinding device for profile precision consistency is provided, in which, a supporting plate passes through an inner cylinder, and is fixed to the inner cylinder, the inner cylinder is rotatably connected to an outer cylinder bracket, a winding reel and an unwinding reel are arranged side by side in a left-right direction at an upper end of the supporting plate, and are driven by respective first servo motors arranged corresponding to the winding reel and the unwinding reel, and a first transition wheel and a second transition wheel are arranged side by side in the left-right direction at an upper portion of the supporting plate, and a first tension pulley and a second tension pulley are arranged side by side in the left-right direction at a middle lower portion of the supporting plate, and a third transition wheel and a fourth transition wheel are arranged side by side in the left-right direction at a lower end of the supporting plate, a fifth transition wheel is arranged at the lower left of the third transition wheel, a seventh transition wheel is arranged at the lower right of the third transition wheel, a sixth transition wheel is arranged at the lower right of the fourth transition wheel, and an eighth transition wheel is arranged at the lower left of the fourth transition wheel, a contact rod is suspended at a bottom end of the supporting plate, and a contact wheel is installed at a lower end of the contact rod, and the abrasive belt has one end wound in a belt groove of the winding reel, and another end wound over the first transition wheel, the first tension pulley, the third transition wheel, the fifth transition wheel, the seventh transition wheel, the contact wheel, the eighth transition wheel, the sixth transition wheel, the fourth transition wheel, the second tension pulley and the second transition wheel, and finally wound in a belt groove of the unwinding reel.

With the above technical solutions, the first servo motor configured to drive the winding reel is a winding motor, and the first servo motor configured to drive the unwinding reel is an unwinding motor. A servo driver controls the winding motor to rotate forward, and the winding motor transmits power to the winding reel, to allow the winding reel to rotate forward to wind the belt; and meanwhile, the driver of the unwinding motor controls the unwinding motor to rotate forward, and the unwinding motor transmits power to the unwinding reel, to allow the unwinding reel to rotate forward to unwind the belt. In the grinding process, the magnitude of the tensile force of the abrasive belt is determined by controlling a torque of the first servo motor, to ensure the precision and surface quality of the ground workpiece and also reduce failures such as belt breakage in the grinding process. The winding and unwinding of the winding reel depends on the rotating direction of the first servo motor and the direction of winding of the abrasive belt. For achieving a reciprocating grinding by the abrasive belt, when reaching a certain position, the unwinding motor rotates backwards to drive the winding reel to rotate backwards, and the unwinding motor rotates backwards to drive the unwinding reel to rotate backwards, thus the winding reel is switched into an unwinding state, and the unwinding reel is switched into a winding state. The instant acceleration of the first servo motor depends on the diameters of the abrasive belt coil of the winding reel and the unwinding reel. The inner cylinder is rotatably connected to the outer cylinder bracket, and can be linked with other shafts of the machine tool, to perform grinding and polishing on a complex curved surface.

The abrasive belt wheel train with the above structure has a reasonable space arrangement, can ensure the reliability of running of the abrasive belt. The first tension pulley and the second tension pulley are mainly configured to tension the abrasive belt when the abrasive belt is diverted reciprocatingly, to prevent the slipping of the abrasive belt. The tension pulley is spaced away from the contact wheel by a large distance, and the transition wheels are also arranged at a lower end of the supporting plate, the fifth and sixth transition wheels enables the abrasive belt to be stretched in a large extent, to reduce the slipping of the abrasive belt. The seventh and eighth transition wheels are mainly configured to close up the abrasive belt, to allow the abrasive belt to be adapted to the contact wheel having a small dimension.

The winding reel and the unwinding reel have the same structure, and each includes an inner disc and an outer disc, and the inner disc and the outer disc are sleeved on a connecting shaft side by side, and a belt groove is formed between the inner disc and the outer disc, an inner end of the connecting shaft is sleeved on an output shaft of the respective first servo motor, and the inner end of the connecting shaft and the output shaft of the respective first servo motor are connected by a key, and a body of the first servo motor is fixed onto the supporting plate by a mounting base. The winding reel with the above structure can be simply molded, is easy to assemble, and can operate freely, the belt groove is formed between the two discs, thus may effectively avoid the slipping of the abrasive belt.

A locking key is provided at an outer side of the outer disc, and the locking key is a rectangular block, the locking key passes through a fitting hole provided correspondingly in the connecting shaft, and the locking key is located in an elongated groove provided in the outer disc, and an elongated hole is further provided in the outer disc, and the elongated hole and the elongated groove intersect at right angles; a handle is provided at an outer side of the locking key, the handle is sleeved on an outer end of the connecting shaft, the handle is connected to the locking key by a bolt; a compression spring is sleeved on the bolt, and is located inside the connecting shaft, the compression spring has one end abutting against the locking key, and another end abutting against a spring seat embedded into the connecting shaft. In the above structure, the locking pin is embedded into the elongated groove of the outer disc under the action of the compression spring, to fix the position of the outer disc, which can not only prevent the outer disc from playing axially, but also prevent the outer disc from rotating with respect to the connecting shaft. When it needs to replace the abrasive belt, the handle is pulled first, to compress the compression spring, and to allow the locking key to be disengaged from the elongated groove of the outer disc, and then the handle is rotated by 90 degrees, to allow the locking key to rotate by 90 degrees along with the handle and then be placed into the elongated hole of the outer disc. In this case, the locking key loses the positioning effect to the outer disc, and the outer disc can be removed to replace the abrasive belt, thus the whole operation is simple, convenient, and fast.

The first tension pulley and the second tension pulley have the same mounting structure, the first tension pulley is sleeved on an axle by a bearing, and the axle is fixed to a lower end of a first connecting rod, and an upper end of the first connecting rod is connected to one end of a second connecting rod, the second connecting rod is perpendicular to the first connecting rod, and another end of the second connecting rod is connected to a through pin, the through pin passes through the supporting plate and is connected to a lower end of a tension spring, and an upper end of the tension spring is connected to a fixing rod, and the fixing rod is fixed to the supporting plate. In the above structure, the two tension pulleys are subjected to a tensile force applied by the abrasive belt, and the tension spring is tensioned, to allow the two tension pulleys to move to the middle to get close to each other, in this way, the tension pulleys may have a buffer effect, which can avoid breakage of belt caused by a sudden variation of the tensile force of the abrasive belt.

The inner cylinder is supported in an outer cylinder by a bearing, and the outer cylinder is fixed to the outer cylinder bracket, a second servo motor is mounted on the outer cylinder bracket, and a synchronous driving pulley is sleeved on an output shaft of the second servo motor, and the synchronous driving pulley is connected to a synchronous driven pulley sleeved on the inner cylinder by a synchronous toothed belt. In the above structure, the synchronous driving pulley is driven by the second servo motor, thus the inner cylinder can be driven to rotate, to change a swaying angle of the contact wheel, to achieve linkage between the inner cylinder and other shafts of the machine tool, thereby machining the complex profiles.

The outer cylinder bracket is fixed to a grinding head supporting plate, and a third servo motor is mounted on the grinding head supporting plate, an output shaft of the third servo motor is connected to a gear shaft via a coupler, and the gear shaft is configured to roll in a circular arc-shaped sliding slot provided in a bed, a gear is provided on the gear shaft, and a circular arc-shaped rack configured to engage with the gear is provided on the bed. In the above structure, the third servo motor is connected to the gear shaft via the coupler, and the gear shaft rolls inside the sliding slot of the bed, to drive the gear to rotate. The rack is fixed to the bed, and the gear rotates with respect to the rack, and the gear shaft is fixedly connected to the grinding head supporting plate, and the rotations of the gear and the gear shaft drive the grinding head supporting plate to rotate, and thus, the entire grinding head rotates with the grinding head supporting plate. In this way, the workpiece can be placed horizontally, thus facilitating the mounting and dismounting of the workpiece and reducing collision and wear of the workpiece. Further, the space can be saved, three grinding devices can be arranged on the left, the right and the rear of the workpiece, thus large members having multiple blades such as a blisk may be simultaneously machined at multiple stations and the machining efficiency can be significantly improved. With the gear engagement manner, the grinding head can sway at a large angle of ±30 degrees, and can be adapted to the grinding of workpieces with a great surface curvature variation.

The beneficial effects of the present application are as follows.

1. The winding and unwinding of the abrasive belt are controlled by double motors, thus, a fast response can be achieved, and the moving direction of the abrasive belt in the grinding process can be changed, to facilitate controlling of the movement of the abrasive belt, and with such a reciprocating grinding by the abrasive belt, the total length of the abrasive belt participating in the grinding process can be reduced.

2. The magnitude of the tensile force of the abrasive belt is determined by controlling the torque of the motor, thus the precision and surface quality of the ground workpiece can be improved and also failures such as belt breakage in the grinding process can be reduced.

3. A bearing is mounted between the outer cylinder and the inner cylinder of the grinding head, and the outer cylinder is fixed, the servo motor drives the inner cylinder to rotate through the synchronous belt, to allow the linkage between the inner cylinder and other shafts of the machine tool, to grind and polish complex curved surfaces.

4. The grinding head driving device is embodied in the form of a gear and a rack, with such a manner, the workpiece can be placed horizontally, thus facilitating the mounting and dismounting of the workpiece and reducing collision and wear of the workpiece compared with a vertical mounting manner. Further, the space can be saved, three grinding devices can be arranged on the left, the right and the rear of the workpiece, thus large members having multiple blades such as a blisk may be simultaneously machined at multiple stations and the machining efficiency can be significantly improved. With the gear engagement manner, the grinding head can sway at a large angle of ±30 degrees, and can be adapted to the grinding of workpieces with a great surface curvature variation.

DETAILED DESCRIPTION

The present application is further described hereinafter with reference to the drawings and embodiments.

Figure 1:
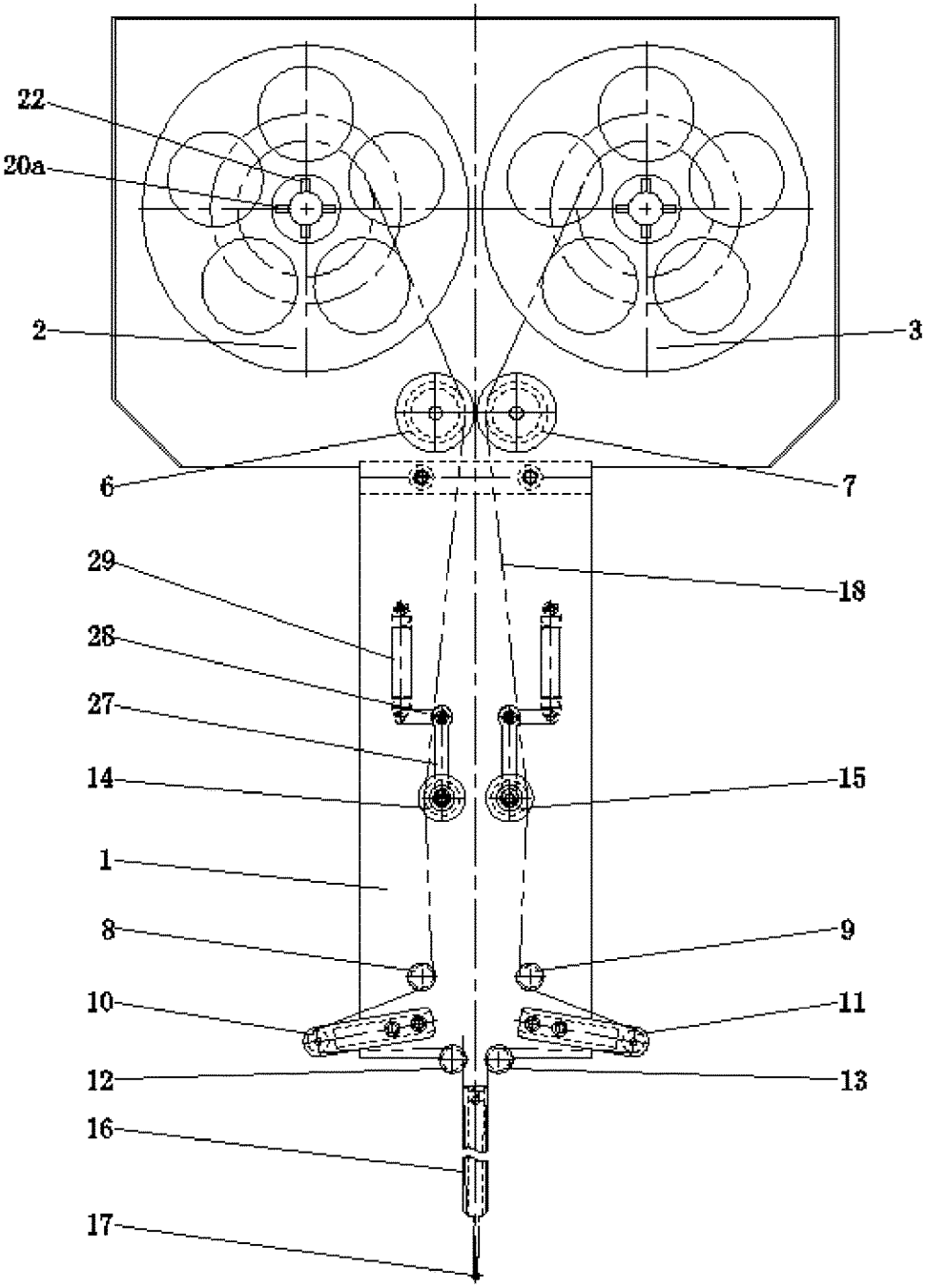
FIG. 1 is a schematic view showing the structure of an embodiment of the present application.
Figure 2:
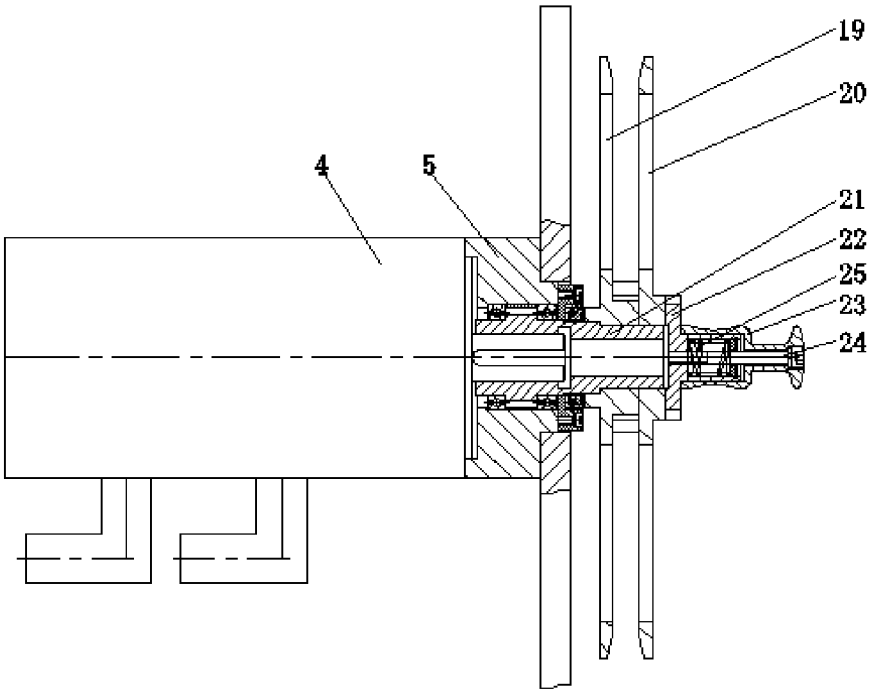
FIG. 2 is a schematic view showing the structure and assembling of a reel.
Figure 4:
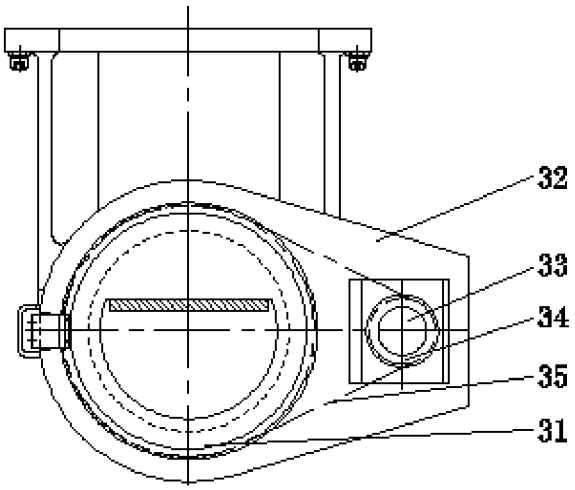
FIG. 4 is a schematic view of a driving structure of an inner cylinder.

As shown in FIGS. 1, 2, and 4, a supporting plate 1 is preferably T-shaped, and passes through an inner cylinder 31, and the supporting plate 1 is fixed to the inner cylinder 31. A winding reel 2 and an unwinding reel 3 are arranged side by side in a left-right direction on an upper end of the supporting plate 1, and are distributed symmetrically with respect to the center line of the supporting plate 1, the winding reel 2 and the unwinding reel 3 are respectively driven by respective first servo motors 4 arranged corresponding to the winding reel 2 and the unwinding reel 3. The winding reel 2 and the unwinding reel 3 have the same structure, and each include an inner disc 19 and an outer disc 20. The inner disc 19 and the outer disc 20 are sleeved on a connecting shaft 21 side by side, and a belt groove is formed between the inner disc 19 and the outer disc 20. An inner end of the connecting shaft 21 is sleeved on an output shaft of the respective first servo motor 4, and the inner end of the connecting shaft 21 and the output shaft of the respective first servo motor 4 are connected by a key, and a body of the first servo motor 4 is fixed to the supporting plate 1 by a mounting base 5.

As shown in FIGS. 1 and 2, a locking key 22 is provided at an outer side of the outer disc 20, and the locking key 22 is embodied as a rectangular block. The locking key 22 is perpendicular to the connecting shaft 21, and the locking key 22 passes through a fitting hole provided correspondingly in the connecting shaft 21, and the shape of the fitting hole is adapted to a moving track of the locking key 22. Two ends of the locking key 22 are located in an elongated groove provided in the outer disc 20, and an elongated hole 20*a* is further provided in the outer disc 20, and the elongated hole 20*a* and the elongated groove intersect at right angles. A handle 23 is provided at an outer side of the locking key 22, the handle 23 is a hollow structure, and is idly sleeved on an outer end of the connecting shaft 21. The handle 23 is fixedly connected to a middle portion of the locking key 22 by a bolt 24 passing through the axis of the handle 23. A compression spring 25 is sleeved on the bolt 24, and is located inside the connecting shaft 21. The compression spring 25 has one end abutting against the locking key 22, and has another end abutting against a spring seat embedded into the connecting shaft 21. Under the action of the compression spring 25, the locking key 22 is embedded into the elongated groove in the outer disc 20, to fix the position of the outer disc 20. When it requires to remove the outer disc 20, the handle 23 is pulled first, to compress the compression spring 25, which allows the locking key 22 to be disengaged from the elongated groove in the outer disc 20, and then the handle 23 is rotated by 90 degrees, to allow the locking key 22 to be rotated by 90 degrees along with the handle 23 and to be placed in the elongated hole 20*a* of the outer disc 20, and in this case, the locking key 22 loses the function of positioning the outer disc 20, and the outer disc 20 can be remove to replace the abrasive belt.

Figure 3:
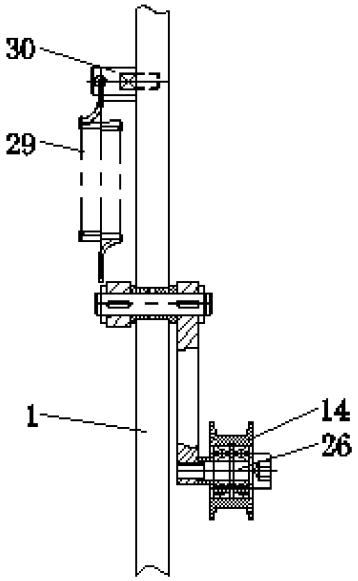
FIG. 3 is a schematic view showing the structure of a tension pulley.

As shown in FIGS. 1 and 3, a first transition wheel 6 and a second transition wheel 7 are arranged side by side in the left-right direction on an upper portion of the supporting plate 1, and the first transition wheel 6 and the second transition wheel 7 adjoin each other, and are distributed symmetrically with respect to the center line of the supporting plate 1. A first tension pulley 14 and a second tension pulley 15 are arranged side by side in the left-right direction at a middle lower portion of the supporting plate 1, and are distributed symmetrically with respect to the center line of the supporting plate 1. The first tension pulley 14 and the second tension pulley 15 have the same mounting structure, and in this embodiment, only the mounting structure of the first tension pulley 14 is described as an example. The first tension pulley 14 is sleeved on an axle 26 by a bearing, and the axle 26 is fixed to a lower end of a first connecting rod 27, and an upper end of the first connecting rod 27 is connected to one end of a second connecting rod 28. The second connecting rod 28 is perpendicular to the first connecting rod 27, and has another end connected to a through pin. The through pin passes through the supporting plate 1 and is connected to a lower end of a tension spring 29. An upper end of the tension spring 29 is connected to a fixing rod 30, and the fixing rod 30 is fixed to the supporting plate 1.

As shown in FIG. 1, a third transition wheel 8 and a fourth transition wheel 9 are arranged side by side in the left-right direction at a lower end of the supporting plate 1, and are distributed symmetrically with respect to the center line of the supporting plate 1. The distance between the third transition wheel 8 and the fourth transition wheel 9 is greater than the distance between the first tension pulley 14 and the second tension pulley 15. A fifth transition wheel 10 is arranged at the lower left of the third transition wheel 8, and a seventh transition wheel 12 is arranged at the lower right of the third transition wheel 8, a sixth transition wheel 11 is arranged at the lower right of the fourth transition wheel 9, and an eighth transition wheel 13 is arranged at the lower left of the fourth transition wheel 9. The fifth transition wheel 10 and the sixth transition wheel 11 are distributed symmetrically with respect to the center line of the supporting plate 1, and the seventh transition wheel 12 and the eighth transition wheel 13 are also distributed symmetrically with respect to the center line of the supporting plate 1, and the seventh transition wheel 12 is located at the lower right of the fifth transition wheel 10.

As shown in FIG. 1, a contact rod 16 is suspended at a bottom end of the supporting plate 1, and an upper end of the contact rod 16 is fixed to the supporting plate 1 by a screw, and a contact wheel 17 is installed at a lower end of the contact rod 16. The contact wheel 17 may be worn in different extents during the grinding process, and when the contact wheel 17 is scrap, the contact rod 16 may be conveniently detached to replace the contact wheel 17. In the grinding process, the contact wheels 17 having corresponding diameters are selected and replaced according to different curvatures of the surface, to be machined, of the workpiece. If the contact rod 16 cannot meet the assembling requirement of the contact wheel 17, it simply needs to change the dimension of a tail end of the contact rod 16 to re-select and then machine the contact rod 16.

As shown in FIGS. 1, 2, and 3, one end of the abrasive belt 18 is wound in the belt groove of the winding reel 2, and another end of the abrasive belt 18 is wound over the first transition wheel 6, the first tension pulley 14, the third transition wheel 8, the fifth transition wheel 10, the seventh transition wheel 12, the contact wheel 17, the eighth transition wheel 13, the sixth transition wheel 11, the fourth transition wheel 9, the second tension pulley 15, and the second transition wheel 7, and is finally wound in the belt groove of the unwinding reel 3. The first tension pulley 14 and the second tension pulley 15 are subjected to a tensile force of the abrasive belt 18, and the tension spring 29 is tensioned, to enable the two tension pulleys to move toward the middle to get close to each other, in this way, the tension pulleys have a buffer effect, and can avoid the breakage of the abrasive belt caused by a sudden variation of the tensile force of the abrasive belt.

As shown in FIGS. 1 and 2, the first servo motor configured to drive the winding reel 2 is a winding motor, and the first servo motor configured to drive the unwinding reel 3 is an unwinding motor. In the grinding process of the abrasive belt, the winding and unwinding method according to the present application is as follow.

A servo driver controls the winding motor to rotate forward, and the winding motor transmits power to the winding reel 2, to allow the winding reel 2 to rotate forward to wind the belt; meanwhile, a driver of the unwinding motor controls the unwinding motor to rotate forward, and the unwinding motor transmits power to the unwinding reel 3, to allow the unwinding reel 3 to rotate forward to unwind the belt. The tensile force of the abrasive belt 18 is adjusted by controlling the torque of the first servo motor, to ensure the precision and surface quality of the ground workpiece. In this device, the winding and unwinding of the winding reel depends on the rotating direction of the first servo motor and the direction of winding of the abrasive belt. For achieving a reciprocating grinding by the abrasive belt 18, when the belt is winded or unwound to a certain position, the winding motor rotates backward to drive the winding reel 2 to rotate backward, and the unwinding motor rotates backward to drive the unwinding reel 3 to rotate backward, thus the winding reel 2 is switched into a state for unwinding the belt, and the unwinding reel 3 is switched into a state for winding the belt, and the abrasive belt 18 grinds the workpiece in a reverse direction, and the above process is repeated, and this reciprocating manner allows grinding by a short abrasive belt 18.

A servo motor is employed to drive the winding reel 2 and the unwinding reel 3 directly, and the model selection of the servo motor may be varied. In the present application, the linear speed of the abrasive belt has a large adjustment range, which can meet the requirements for selecting different abrasive belt linear speeds in grinding and polishing process. To ensure that the abrasive belt has a constant linear speed, the rotating speed of the servo motor is determined by diameters of the abrasive belt coil of the winding reel 2 and the unwinding reel 3.

As shown in FIGS. 1 and 4, the inner cylinder 31 is supported in an outer cylinder by a bearing, and the outer cylinder is fixed to an outer cylinder bracket 32. A second servo motor 33 is mounted on the outer cylinder bracket 32, and a synchronous driving pulley 34 is sleeved on an output shaft of the second servo motor 33, and the synchronous driving pulley 34 is connected to a synchronous driven pulley sleeved on the inner cylinder 31 by a synchronous toothed belt 35. When the second servo motor 33 is started, the second servo motor 33 drives the synchronous driving pulley 34 to rotate, and the synchronous driving pulley 34 drives the synchronous driven pulley and the inner cylinder 31 to rotate together by the synchronous toothed belt 35, and the inner cylinder 31 correspondingly drives the mechanism on the supporting plate 1 to rotate, to achieve linkage between the inner cylinder 31 and other shafts of the machine tool, thereby performing machining of complex profiles.

Figure 5:
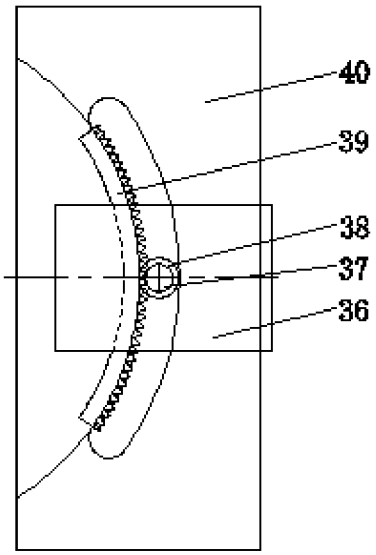
FIG. 5 is a schematic view showing the driving of a grinding head supporting plate.

As shown in FIGS. 4 and 5, the outer cylinder bracket 32 is fixed to a grinding head supporting plate 36, and a third servo motor is mounted on the grinding head supporting plate 36. An output shaft of the third servo motor is connected to a gear shaft 37 via a coupler, and the gear shaft 37 is capable of rolling in a circular arc-shaped sliding slot provided in a bed 40. A gear 38 is provided on the gear shaft 37, and a circular arc-shaped rack 39 configured to engage with the gear 38 is provided on the bed 40. The third servo motor drives the gear shaft 37, to allow the gear 38 to rotate with respect to the circular arc rack 39. The gear shaft 37 is fixedly connected to the grinding head supporting plate 36, and the rotations of the gear 38 and the gear shaft 37 drive the grinding head supporting plate 36 to rotate, and thus, the entire grinding head rotates with the grinding head supporting plate 36. In this way, the workpiece can be placed horizontally, thus facilitating the mounting and dismounting of the workpiece and reducing collision and wear of the workpiece. Further, the space can be saved, three grinding devices can be arranged on the left, the right and the rear of the workpiece, thus large members having multiple blades such as a blisk may be simultaneously machined at multiple stations, thus the machining efficiency can be significantly improved. With the gear engagement manner, the grinding head can sway at a large angle of ±30 degrees, and can be adapted to the grinding of workpieces with a great surface curvature variation.

The preferred embodiments of the present application have been described in detail hereinbefore. It should be understood by the person skilled in the art that various modifications and variations can be made in accordance with the concepts of the present application without any creative efforts. Accordingly, all the technical solutions obtained by the person skilled in the art according to the concepts of the present application on the basis of the conventional technology through logical analysis, reasoning, or limited experiments should be deemed to fall into the scope of protection of the present application as defined by the claims.

What is claimed is:

1. An abrasive belt grinding device for profile precision consistency, wherein a supporting plate passes through an inner cylinder, and is fixed to the inner cylinder, the inner cylinder is rotatably connected to an outer cylinder bracket, a winding reel and an unwinding reel are arranged side by side in a left-right direction at an upper end of the supporting plate, and are driven by respective first servo motors arranged corresponding to the winding reel and the unwinding reel; a first transition wheel and a second transition wheel are arranged side by side in the left-right direction at an upper portion of the supporting plate, and a first tension pulley and a second tension pulley are arranged side by side in the left-right direction at a middle lower portion of the supporting plate, and a third transition wheel and a fourth transition wheel are arranged side by side in the left-right direction at a lower end of the supporting plate, a fifth transition wheel arranged at the lower left of the third transition wheel, a seventh transition wheel is arranged at the lower right of the third transition wheel, a sixth transition wheel is arranged at the lower right of the fourth transition wheel, and an eighth transition wheel is arranged at the lower left of the fourth transition wheel, a contact rod is suspended at a bottom end of the supporting plate, and a contact wheel is installed at a lower end of the contact rod, and an abrasive belt has one end wound in a belt groove of the winding reel and another end wound over the first transition wheel, the first tension pulley, the third transition wheel, the fifth transition wheel, the seventh transition wheel, the contact wheel, the eighth transition wheel, the sixth transition wheel, the fourth transition wheel, the second tension pulley and the second transition wheel, and finally wound in a belt groove of the unwinding reel.

2. The abrasive belt grinding device for profile precision consistency according to claim 1, wherein the winding reel and the unwinding reel have the same structure, and each comprises an inner disc and an outer disc, the inner disc and the outer disc are sleeved on a connecting shaft side by side, and a belt groove is formed between the inner disc and the outer disc; an inner end of the connecting shaft is sleeved on an output shaft of the respective first servo motor, and the inner end of the connecting shaft and the output shaft of the respective first servo motor connected by a key, and a body of the first servo motor is fixed onto the supporting plate by a mounting base.

3. The abrasive belt grinding device for profile precision consistency according to claim 2, wherein a locking key is provided at an outer side of the outer disc, and the locking key is a rectangular block, the locking key passes through a fitting hole provided correspondingly in the connecting shaft, and the locking key is located in an elongated groove provided in the outer disc, and an elongated hole further provided in the outer disc, and the elongated hole and the elongated groove intersect at right angles; a handle is provided at an outer side of the locking key, the handle is sleeved on an outer end of the connecting shaft, the handle is connected to the locking key by a bolt, a compression spring is sleeved on the bolt, and is located inside the connecting shaft, and the compression spring has one end abutting against the locking key and another end abutting against a spring seat embedded into the connecting shaft.

4. The abrasive belt grinding device for profile precision consistency according to claim 1, wherein the first tension pulley and the second tension pulley have a same mounting structure, the first tension pulley is sleeved on an axle by a bearing, and the axle is fixed to a lower end of a first connecting rod, and an upper end of the first connecting rod is connected to one end of a second connecting rod, the second connecting rod is perpendicular to the first connecting rod, and another end of the second connecting rod is connected to a through pin, the through pin passes through the supporting plate and is connected to a lower end of a tension spring, an upper end of the tension spring is connected to a fixing rod, and the fixing rod is fixed to the supporting plate.

5. The abrasive belt grinding device for profile precision consistency according to claim 1, wherein the inner cylinder is supported in an outer cylinder by a bearing, and the outer cylinder is fixed to the outer cylinder bracket, a second servo motor is mounted on the outer cylinder bracket, and a synchronous driving pulley is sleeved on an output shaft of the second servo motor, and the synchronous driving pulley is connected to a synchronous driven pulley sleeved on the inner cylinder by a synchronous toothed belt.

6. The abrasive belt grinding device for profile precision consistency according to claim 5, wherein the outer cylinder bracket is fixed to a grinding head supporting plate, and a third servo motor is mounted on the grinding head supporting plate, an output shaft of the third servo motor is connected to a gear shaft via a coupler, and the gear shaft is configured to roll in a circular arc-shaped sliding slot provided in a bed, a gear is provided on the gear shaft, and a circular arc-shaped rack configured to engage with the gear is provided on the bed.

7. The abrasive belt grinding device for profile precision consistency according to claim 2, wherein the inner cylinder is supported in an outer cylinder by a bearing, and the outer cylinder is fixed to the outer cylinder bracket, a second servo motor is mounted on the outer cylinder bracket, and a synchronous driving pulley is sleeved on an output shaft of the second servo motor, and the synchronous driving pulley is connected to a synchronous driven pulley sleeved on the inner cylinder by a synchronous toothed belt.

8. The abrasive belt grinding device for profile precision consistency according to claim 7, wherein the outer cylinder bracket is fixed to a grinding head supporting plate, and a third servo motor is mounted on the grinding head supporting plate, an output shaft of the third servo motor is connected to a gear shaft via a coupler, and the gear shaft is configured to roll in a circular arc-shaped sliding slot provided in a bed, a gear is provided on the gear shaft, and a circular arc-shaped rack configured to engage with the gear is provided on the bed.

9. The abrasive belt grinding device for profile precision consistency according to claim 3, wherein the inner cylinder is supported in an outer cylinder by a bearing, and the outer cylinder is fixed to the outer cylinder bracket, a second servo motor is mounted on the outer cylinder bracket, and a synchronous driving pulley is sleeved on an output shaft of the second servo motor, and the synchronous driving pulley is connected to a synchronous driven pulley sleeved on the inner cylinder by a synchronous toothed belt.

10. The abrasive belt grinding device for profile precision consistency according to claim 9, wherein the outer cylinder bracket is fixed to a grinding head supporting plate, and a third servo motor is mounted on the grinding head supporting plate, an output shaft of the third servo motor is connected to a gear shaft via a coupler, and the gear shaft is configured to roll in a circular arc-shaped sliding slot provided in a bed, a gear is provided on the gear shaft, and a circular arc-shaped rack configured to engage with the gear is provided on the bed.

11. The abrasive belt grinding device for profile precision consistency according to claim 4, wherein the inner cylinder is supported in an outer cylinder by a bearing, and the outer cylinder is fixed to the outer cylinder bracket, a second servo motor is mounted on the outer cylinder bracket, and a synchronous driving pulley is sleeved on an output shaft of the second servo motor, and the synchronous driving pulley is connected to a synchronous driven pulley sleeved on the inner cylinder by a synchronous toothed belt.

12. The abrasive belt grinding device for profile precision consistency according to claim 11, wherein the outer cylinder bracket is fixed to a grinding head supporting plate, and a third servo motor is mounted on the grinding head supporting plate, an output shaft of the third servo motor is connected to a gear shaft via a coupler, and the gear shaft is configured to roll in a circular arc-shaped sliding slot provided in a bed, a gear is provided on the gear shaft, and a circular arc-shaped rack configured to engage with the gear is provided on the bed.

* * * * *